United States Patent [19]

Bonazzo

[11] Patent Number: 4,540,302

[45] Date of Patent: Sep. 10, 1985

[54] APPLICATOR DEVICE

[76] Inventor: Robert E. Bonazzo, 27 Bonazzo Dr., Trumbull, Conn. 06611

[21] Appl. No.: 487,450

[22] Filed: Apr. 21, 1983

[51] Int. Cl.[3] ..... B43K 5/06; B43K 21/08

[52] U.S. Cl. ..... 401/173; 401/75

[58] Field of Search ..... 401/49, 55, 75, 64, 401/72, 171, 172, 173, 174, 175, 176, 183, 191, 193, 286, 287, 288; 132/79 R, 79 A, 79 C

[56] References Cited

U.S. PATENT DOCUMENTS

| | | | |
|---|---|---|---|
| 1,990,031 | 2/1935 | Janer | 401/75 |
| 2,205,808 | 6/1940 | Bolinger | 401/173 |
| 2,980,246 | 4/1961 | Leshin | 401/55 |
| 3,333,740 | 8/1967 | Waller | 401/75 |

*Primary Examiner*—Hugh R. Chamblee
*Assistant Examiner*—Carolyn A. Harrison

[57] ABSTRACT

A cap is removably secured to the upper end of a vertical hollow cylinder. The cylinder has an internal thread. A cylindrical member having a threaded outer surface is disposed inside the cylinder with the inner thread engaging the outer thread. A solid cylinder of disposable applicator material is disposed in the hollow cylinder between cap and member. A cover is rotatably secured to the lower end of the hollow cylinder and has a vertical extension extending through a central bore in the member into the solid cylinder.

1 Claim, 2 Drawing Figures

APPLICATOR DEVICE

BACKGROUND OF THE INVENTION

Many types of applicator devices such as those used for applying lipstick solid deodorants and the like are in wide present use. Typically such devices take the form of a hollow cylinder with a removable cap at one end and a manually rotatable screw extending axially upward in the cylinder from the other end. A flat disc inside the cylinder has a centrally disposed member with a central bore having an internal thread. The screw engages the bore whereby rotation of the screw raises or lowers the member in the cylinder. The solid material to be applied such as lipstick or deodorant takes the form of a solid cylinder disposed inside the hollow cylinder. The lower end of the solid cylinder rests on the member. The upper end of the cylinder extends upwardly toward the cap. In use, the cap is removed and the solid cylinder is used in application. As portions of the solid cylinder are consumed, the screw is rotated to raise the remaining portion of the solid cylinder into position for use.

In assembling such devices for use the hollow cylinder with cap removed and flat disc and screw in place with the disc in lowest position is held vertically upright and the material to be applied is poured in as a hot viscous substance which solidifies in place to form the solid cylinder. The cap is then secured to the hollow cylinder to complete the assembly.

The present invention is directed toward a new type of applicator device which can be filled with the applicator substance while the cap is in position whereby a larger solid cylinder can be contained in this device as compared to known devices of same dimension and moreover the assembly operation is simplified.

SUMMARY OF THE INVENTION

In accordance with the principles of this invention, an applicator device employs a vertical hollow cylinder open at upper and lower ends and having an internally threaded inner wall. A hollow cap is removably secured to the upper end of the hollow cylinder.

A cylindrical member having an externally threaded outer wall is disposed within the hollow cylinder with the external thread of the member engaging the inner thread of the hollow cylinder. The axis of the member is coincident with the axis of the hollow cylinder and the member is much shorter in length than that of the hollow cylinder. The member is rotatable about its axis and moves up and down within the hollow cylinder as the member rotates, the direction of travel being determined by the direction of rotation. The member has a vertical bore extending entirely through and aligned with the axis.

A hollow cover rotatably engages the lower end of the hollow cylinder and is provided with a vertical extension which extends into the bore to engage the member whereby as the cover is rotated, the member rotates and moves along the axis of the cylinder. A solid cylinder of disposable applicator material is disposed within the hollow cylinder and cap and rests on the member for use in conventional manner.

However, before the cover is connected in place, the hollow cylinder with cap in position and member disposed in the hollow cylinder adjacent the lower end of the hollow cylinder is inverted and the disposable material in the form of a hot viscous substance is poured into the hollow cylinder and cap via the central bore of the member. The cover is then connected with the vertical extension extending through the bore into the substance before it has cooled and solidified. Once solidification has occurred, the applicator device is ready for use.

DETAILED DESCRIPTION OF PREFERRED EMBODIMENT

Figure 1:
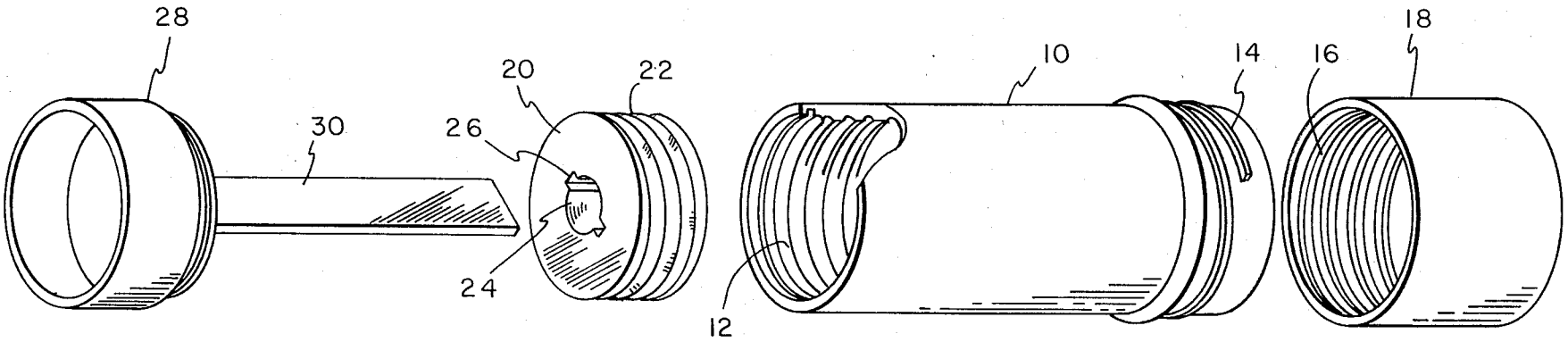
FIG. 1 is an exploded view of the invention showing the different components thereof.
Figure 2:
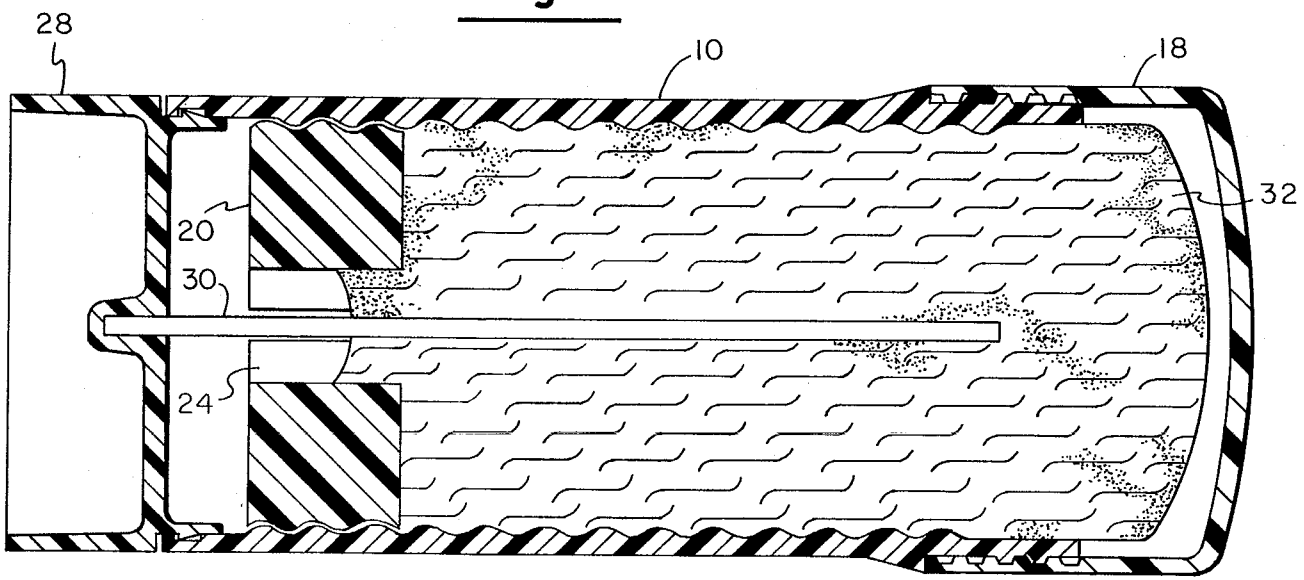
FIG. 2 is a cross sectional view of the invention in assembled form and ready for use.

Referring now to FIGS. 1–2, an elongated hollow plastic cylinder 10 open at both ends has an inner wall with an internal thread 12. One end of the cylinder has an external thread 14 which is detachably engaged by the internal thread 16 of a detachable hollow plastic cap 18.

A cylindrical plastic member 20 much shorter in length than cylinder 10 has an external outer surface with an external thread 22 and is inserted into cylinder 10 with thread 22 engaging thread 12. The axis of member 20 and cylinder 10 are coincident. The member has a relatively large centrally disposed axial bore 24. The bore has an enlarged slotted section 26. Member 20 can be cored out so that material 32 (see below) can be inserted therein.

A hollow plastic cover 28 snap fits into the other end of cylinder 10 so that the cover can be manually rotated within the cylinder. Alternatively the other cylinder end can snap fit into the cover. The cover has a vertical extension in the form of a flat elongated plastic blade 30 which engages the section 26 and extends through the bore into the solid cylindrically shaped applicator material 32. When member 20 is cored out, material 32 fills the inside of member 20 rather than resting on it.

The applicator device is assembled in the manner previously explained.

What is claimed is:

1. An applicator device comprising:

an exterior vertical hollow cylinder open at both upper and lower ends and having an internally threaded inner wall;

an interior cylindrical member having an externally threaded outer wall and being disposed vertically within said cylinder with said external thread engaging the inner thread, said member and said cylinder having a common axis, said member being much shorter in length than said cylinder and having flat upper and lower ends, said member being rotatable about said axis and moving within the cylinder up and down along said axis as said member is rotated, the direction of travel being determined by the direction of rotation, said member having a vertical bore aligned with said axis and extending through said member, said bore having a vertical slotted region;

a vertical cylindrical bottom cover rotatably disposed within the lower end of the cylinder and having a vertical extension shaped to non rotatably engage the slotted region of said bore, said extension extending through said region whereby as the cover is rotated, said member is rotated and moves along the axis of the cylinder;

a hollow cap removably secured to the upper end of the cylinder and spaced from said cover, the cap having a smooth threadless inner wall; and a solid vertical cylinder of disposable applicator material disposed in the vertical hollow cylinder, the solid cylinder having a lower end resting on said member and an upper end disposed within said cap, said member extending upwardly through said bore into the solid cylinder, said solid cylinder having an externally threaded outer wall which engages said inner thread and also having a smooth unthreaded continuation of the threaded outer wall extending into said cap.

* * * * *